US009059488B2

(12) United States Patent
Apostolos et al.

(10) Patent No.: US 9,059,488 B2
(45) Date of Patent: Jun. 16, 2015

(54) SPIRAL SURFACE ELECTROMAGNETIC WAVE DISPERSIVE DELAY LINE

(71) Applicant: AMI Research & Development, LLC, Windham, NH (US)

(72) Inventors: John T. Apostolos, Lyndeborough, NH (US); William Mouyos, Windham, NH (US); Benjamin McMahon, Nottingham, NH (US)

(73) Assignee: AMI Research & Development, LLC, Windham, NH (US)

( * ) Notice: Subject to any disclaimer, the term of this patent is extended or adjusted under 35 U.S.C. 154(b) by 0 days.

(21) Appl. No.: 14/207,948

(22) Filed: Mar. 13, 2014

(65) Prior Publication Data

US 2014/0266503 A1 Sep. 18, 2014

Related U.S. Application Data

(60) Provisional application No. 61/781,543, filed on Mar. 14, 2013.

(51) Int. Cl.
*H01P 9/00* (2006.01)
*H01P 1/18* (2006.01)

(52) U.S. Cl.
CPC ... *H01P 9/00* (2013.01); *H01P 1/18* (2013.01)

(58) Field of Classification Search
CPC ..... H01P 9/02; H01P 9/00; H01P 1/18
USPC ..... 333/157, 162, 163, 242
See application file for complete search history.

(56) References Cited

U.S. PATENT DOCUMENTS

| | | | | |
|---|---|---|---|---|
| 3,047,822 | A * | 7/1962 | Lakatos et al. | 333/162 |
| 4,785,268 | A * | 11/1988 | Walter et al. | 333/157 |
| 4,808,950 | A | 2/1989 | Apostolos et al. | |
| 5,499,005 | A | 3/1996 | Gu et al. | |
| 5,895,775 | A | 4/1999 | Shiau | |
| 5,974,335 | A | 10/1999 | Talisa et al. | |
| 8,260,201 | B2 | 9/2012 | Rossman et al. | |
| 8,610,515 | B2 | 12/2013 | Lan et al. | |
| 2003/0210184 | A1 | 11/2003 | Apostolos | |
| 2005/0146457 | A1 | 7/2005 | Apostolos | |

* cited by examiner

*Primary Examiner* — Benny Lee
(74) *Attorney, Agent, or Firm* — Cesari and McKenna, LLC

(57) ABSTRACT

Dispersive properties of a linear dispersive delay line are retained in a spiral configuration by constraining the radius of curvature depending on a desired propagation mode. The compact form factor spiral can be either a continuous spiral or a piecewise linear approximation. The spiral comprises a highly dielectric waveguide such as titanium dioxide or barium tetratitanate. Preferably, a spacer with a low dielectric constant and a microstrip are disposed on the top surface. The microstrip prevents attenuation of low frequencies, thereby increasing the operating frequency range. A second dielectric spacer and a second microstrip can be deposited on the bottom surface of the waveguide. Alternatively, the bottom surface of the waveguide can face a ground plane. The waveguide can be fed by horns or half-horns.

11 Claims, 5 Drawing Sheets

500

SPIRAL SURFACE ELECTROMAGNETIC WAVE DISPERSIVE DELAY LINE

RELATED APPLICATION

This application claims the benefit of U.S. Provisional Application No. 61/781,543, filed Mar. 14, 2013, the contents of which are hereby incorporated herein by reference.

BACKGROUND

1. Technical Field

This application relates to surface electromagnetic wave dispersive delay lines. It relates especially to high bandwidth dispersive delay lines formed in a compact spiral form factor.

2. Background Information

Dispersive delay lines have been used in defense technology for fifty years, first as matched filters for high power chirp radars, and then as an analog element in a Chirp Fourier Transform which is equivalent to an analog Fast Fourier Transform. By a simple factoring of the expression for the Fourier transform it can be shown that a temporal function or signal which is multiplied by a chirp waveform and fed into a dispersive delay line, matched to the multiplying chirp, produces a temporal waveform which is equivalent to the Fourier transform of the input time signal.

These properties allow signal processing of ultra wide band signals, which require upwards of 100 trillion operations per second, to be implemented without a large amount of massively parallel processing elements consuming tremendous electrical power. It is estimated that a cubic foot worth of surface electromagnetic wave dispersive delay lines and associated hardware consuming 10 watts would match the largest supercomputers at 1000 trillion operations per second in applications such as pattern recognition or neuromorphic computing.

Straight linear surface electromagnetic wave dispersive delay lines have been used since the late 1980s. See, for example, U.S. Pat. No. 4,808,950 to Apostolos et al. entitled "Electromagnetic Dispersive Delay Line", issued Feb. 28, 1989.

SUMMARY OF PREFERRED EMBODIMENTS

A long dispersive delay line is desirable to maximize the time-bandwidth product. The properties of straight linear delay lines are well known. However, it is unclear whether a curved delay line could exhibit the same dispersive properties as a straight delay line. This is especially important in the case of a non-enclosed waveguide where a curvature that is too small would lead to the waveguide radiating and leaking energy.

An electromagnetic dispersive delay line implemented in a spiral or practically spiral configuration provides wideband operation and high dispersion in a relatively compact form factor. In a preferred embodiment, the spiral configuration is shown to retain desired dispersion properties as long as the radius of curvature is constrained. For example, the greatest curvature should be constrained to be somewhat greater than two wavelengths.

In specific implementations, the waveguide may be formed from a suitable dielectric material such as titanium dioxide, barium tetratitanate, or another material exhibiting high dielectric constant.

In order to improve the bandwidth capabilities, the waveguide may be augmented with a transmission line such as a microstrip. In such implementations, the microstrip also follows the same spiral shape as the waveguide.

In an implementation, a microstrip may be disposed on the top surface of the waveguide, separated from the top surface by a spacer layer. In other implementations, a second microstrip may also be deposited on the bottom surface of the same waveguide, also separated by a spacer layer.

In an implementation where a single microstrip is provided on a first surface of the waveguide, the opposite surface of the waveguide is positioned facing a ground plane.

A desired transmission mode for the waveguide, for example, may be an HE 11 transmission mode with the radius of curvature constrained accordingly.

The waveguide and the microstrip may be a continuous fabrication or may be assembled from linear pieces. However, even in the piecewise linear implementation the arrangement of the individual linear slabs should follow the desired radius of curvature that meets the constraints needed to achieve the desired transmission mode.

Feed elements can take any suitable form such as horns or half-horns being fed from below the ground plane if a ground plane is present.

BRIEF DESCRIPTION OF THE DRAWINGS

The description below refers to the accompanying drawings, of which.

DETAILED DESCRIPTION OF AN ILLUSTRATIVE EMBODIMENT

Figure 1:
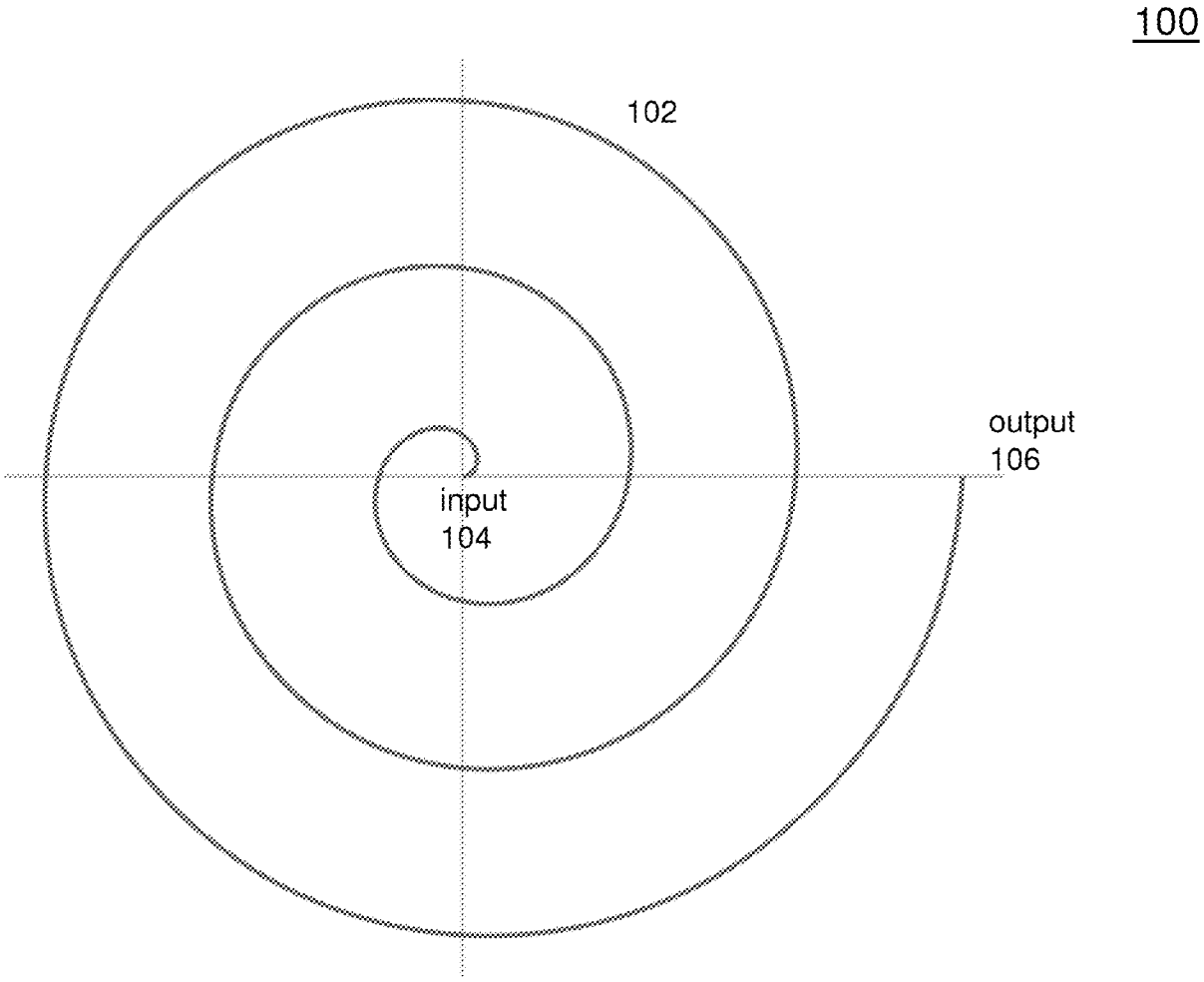
FIG. 1 is a continuous spiral surface electromagnetic wave dispersive delay line.

FIG. 1 is a plan view of a spiral electromagnetic dispersive delay line 100. In this arrangement, the spiral delay line 100 consists of a surface electromagnetic wave dispersive delay line waveguide 102. The delay line waveguide 102 is fed by an input transducer 104 and provides an output at a output transducer 106. In this arrangement, the spiral delay line waveguide 102 generally follows the geometry of an Archimedean spiral. However, it should be understood that other types of spirals could be implemented.

The radius of the spiral should be chosen so that the curvature of the spiral is compatible with a desired transmission mode. In particular, the radius of the spiral should not be so small as to prevent the waveguide from operating in its desired modes. It is known, for example, that in the case of a long straight waveguide, the electromagnetic wave will propagate approximately the same as in a coaxial cable. In case of a sinusoidal excitation, if the segment is considered to be one wavelength long and keeping the current distribution along the straight wire unchanged, the coaxial cable behaves as a pair of rotating dipoles.

Considering the dipole radiation pattern for this configuration allows one to determine the desired radius of curvature for which radiation modes will develop. The circumference of the hypothetical circular section $C=2\pi R$, R is the radius of the circle. Because the segment is being considered to be a single wavelength long, $\lambda=2\pi R$. Solving for R, $R=\lambda/2\pi$. Because it is desired to retain as much of the energy as possible within the waveguide, one should therefore set the radius to be at least equal to but preferably much greater than $\lambda/2\pi$. We call this the small radiation criteria for a free space wavelength $\lambda$. In one example, for operation at a maximum frequency of approximately 20 GHz, $\lambda_{max}$=1.5 cm and R should be at least greater than or equal to $10\lambda_{max}/2\pi$, or 3 cm.

The spiral delay line waveguide 102 would preferably be fabricated from a suitable material such as titanium dioxide, barium tetratitanate, or another appropriate dielectric material with a high dielectric constant. Such a continuous spiral shape can be fabricated using, for example, a waterjet cutter. The resulting spiral shaped material can then be affixed to a conducting ground plane (not shown in FIG. 1). In other implementations, high-frequency delay lines of small size could be fabricated by direct deposition of high dielectric material on the ground plane substrate.

The input 104 and output 106 transducers can be implemented as half horns fed from below the ground plane.

Figure 2:
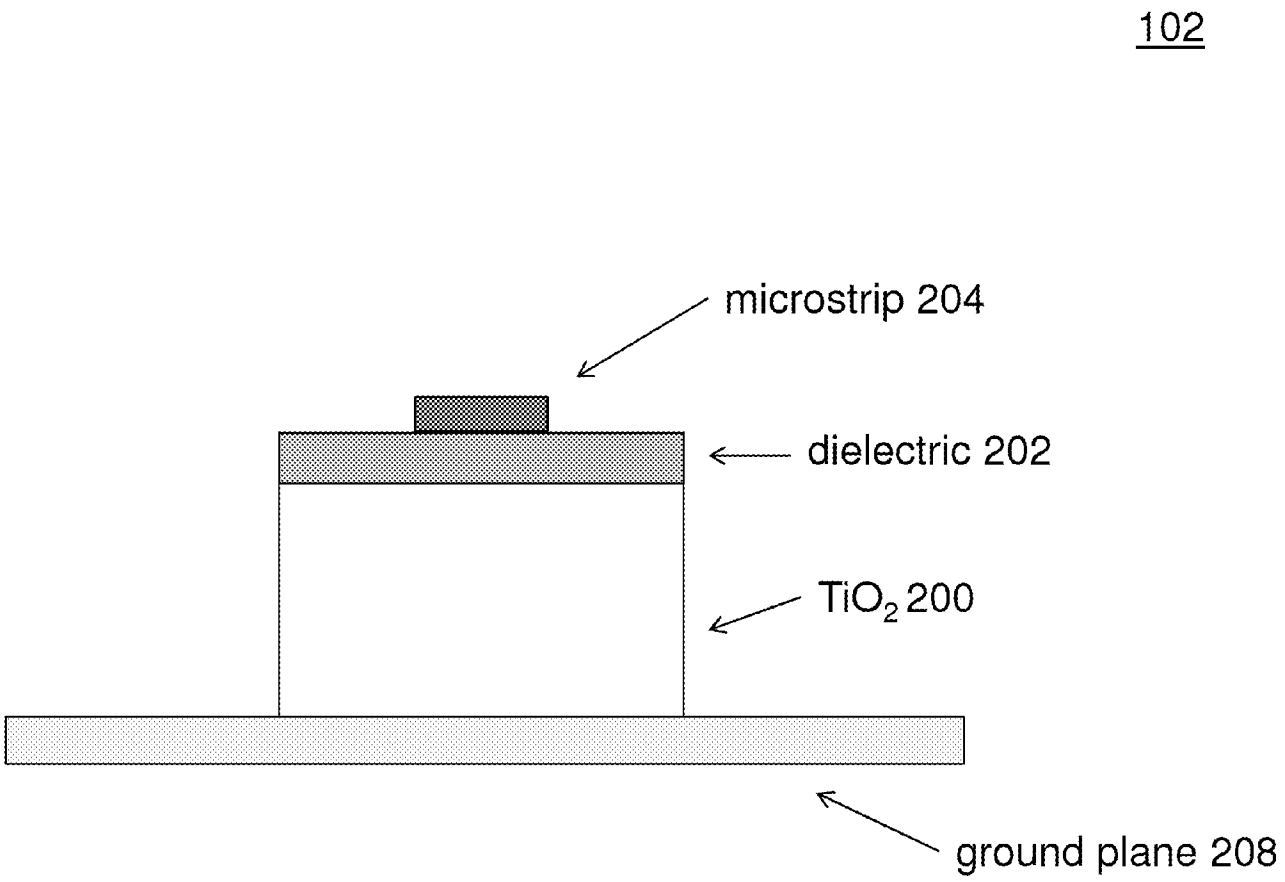
FIG. 2 is a cross-section of the spiral surface electromagnetic wave dispersive delay line mounted on a ground plane.

FIG. 2 shows a cross-section of the delay line 102 of FIG. 1 in more detail. In this embodiment, the waveguide 200 is placed adjacent a ground plane 208. The material of the waveguide 200 is titanium dioxide ($TiO_2$) with a height of $\lambda/4$. A dielectric layer 202 is deposited on top of the titanium dioxide waveguide. This serves the purpose of providing a substrate for a microstrip line 204 placed on top of the structure. The microstrip 204 as well as the dielectric 202 follow the same spiral as the waveguide 200. The dielectric layer 202 is manufactured from a material with a low dielectric constant, such as Teflon™ or polypropylene. Teflon™ is a trademark of E.I. DuPont de Nemours, Inc. of Wilmington, Del. for polytetrafluoroethylene materials.

The implementation here with both the dielectric waveguide 200 and a microstrip 204 positioned proximate to it provides several advantages. For example, at relatively low frequencies the microstrip 204 is primarily responsible for carrying the radiofrequency energy. As frequencies increase, energy will transfer into the waveguide 200. The structure in FIG. 2 thus has two propagation modes: one with energy traveling through the microstrip 204 and one with energy traveling through the dielectric waveguide 200. The desired propagation mode for the dielectric waveguide 200 is the HE 11 propagation mode. Although an operating delay line 100 can be implemented using just the dielectric waveguide 200, including a microstrip line 204 prevents attenuation of low frequencies, thereby increasing the operating frequency range of the delay line 100. It is desirable to make the time bandwidth product of the delay line is great as possible. It is also desirable to enable a smooth transition between the waveguide propagation mode and the microstrip propagation mode of the delay line 100.

Desired dispersion characteristics can be retained in a spiral configuration as long as the radius of curvature of the spiral is properly constrained. By shaping the dispersive delay line in a spiral, one can reduce the form factor needed for packaging. In other words, a dispersive delay line for a given length can be packaged in a small form factor without compromising its operating characteristics.

Figure 3:
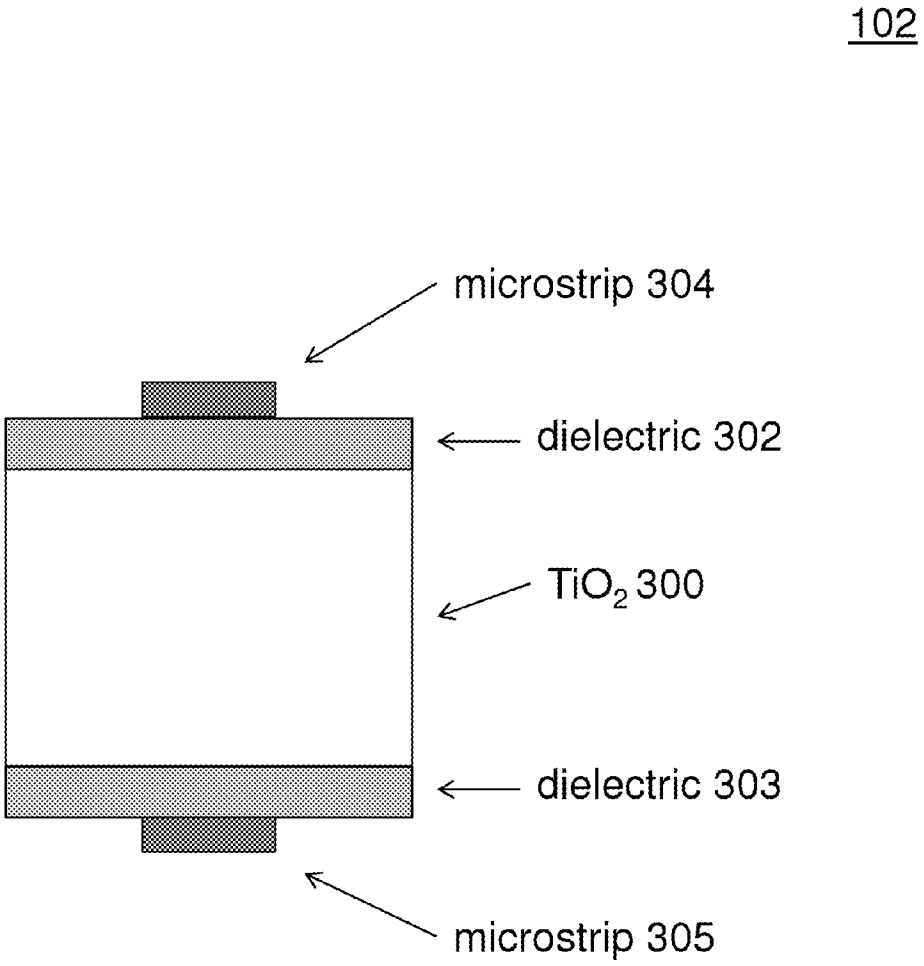
FIG. 3 is a cross-section of the spiral surface electromagnetic wave dispersive delay line without a ground plane.

FIG. 3 shows an alternate arrangement of a dispersive delay line 102. Here, a somewhat thicker waveguide 300 made of Ti02 is provided, with dielectric spacers 302 and 303 deposited on both the top and bottom surfaces. A corresponding top microstrip 304 and bottom microstrip 305 are also provided. In this implementation, the height of the waveguide 300 is approximately equal to $\lambda/2$.

Figure 4:
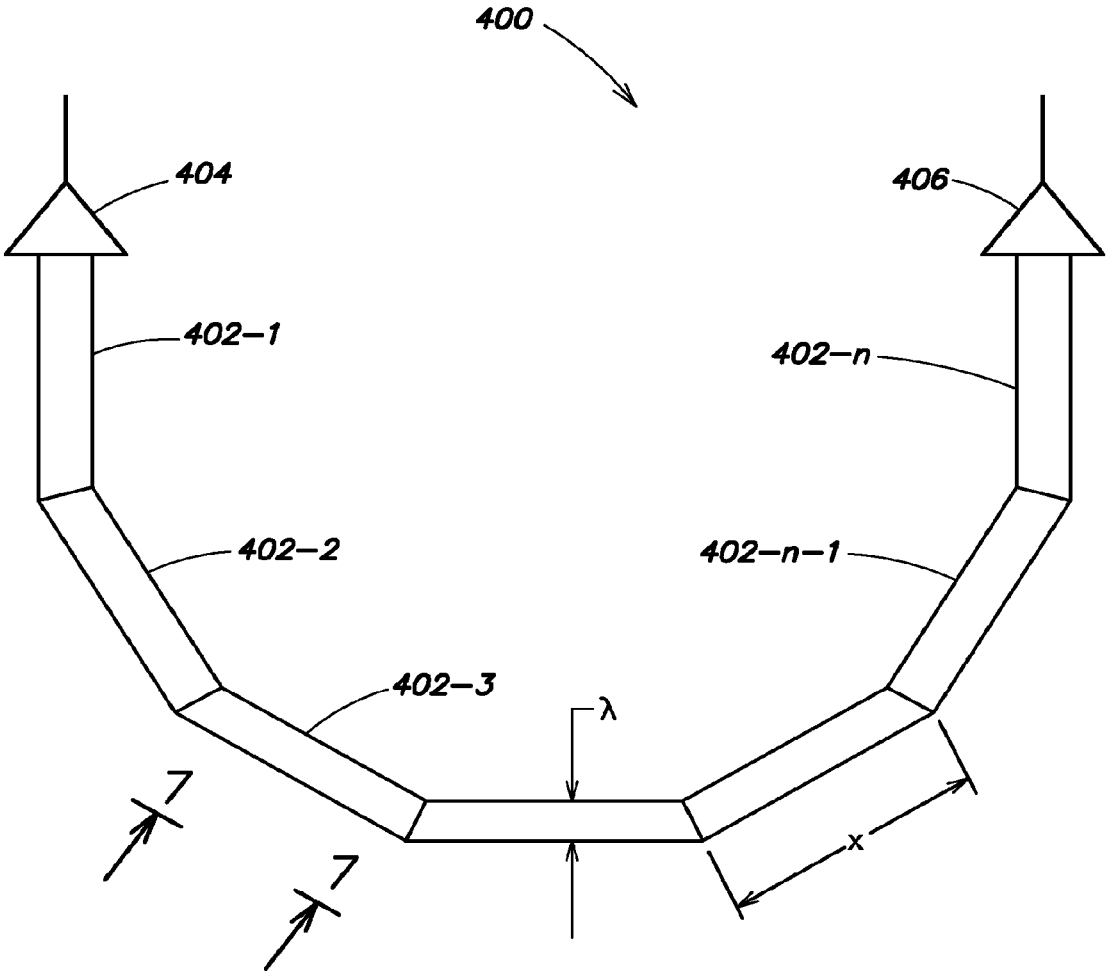
FIG. 4 is a piecewise linear arc construction of a surface electromagnetic wave dispersive delay line.

It has been realized that in some instances it may not be practical to implement a perfectly continuous spiral. A similar effect can be achieved with a piecewise approximation to a spiral curve shape. Such an implementation is shown in FIG. 4. The curved delay line provided is implemented from a set of n linear slabs 402-1, 402-2, . . . **402-*n*−1, 402-*n*. Each of the Ti02 slabs has a cross-section as shown in either FIG. 2 or FIG. 3**. The facing ends of adjacent slabs are angled so that the input and output end abut against one another. In other words, the ends of the slabs such as half-horns are fabricated to be somewhat greater than 90° down from the top.

Figure 5:
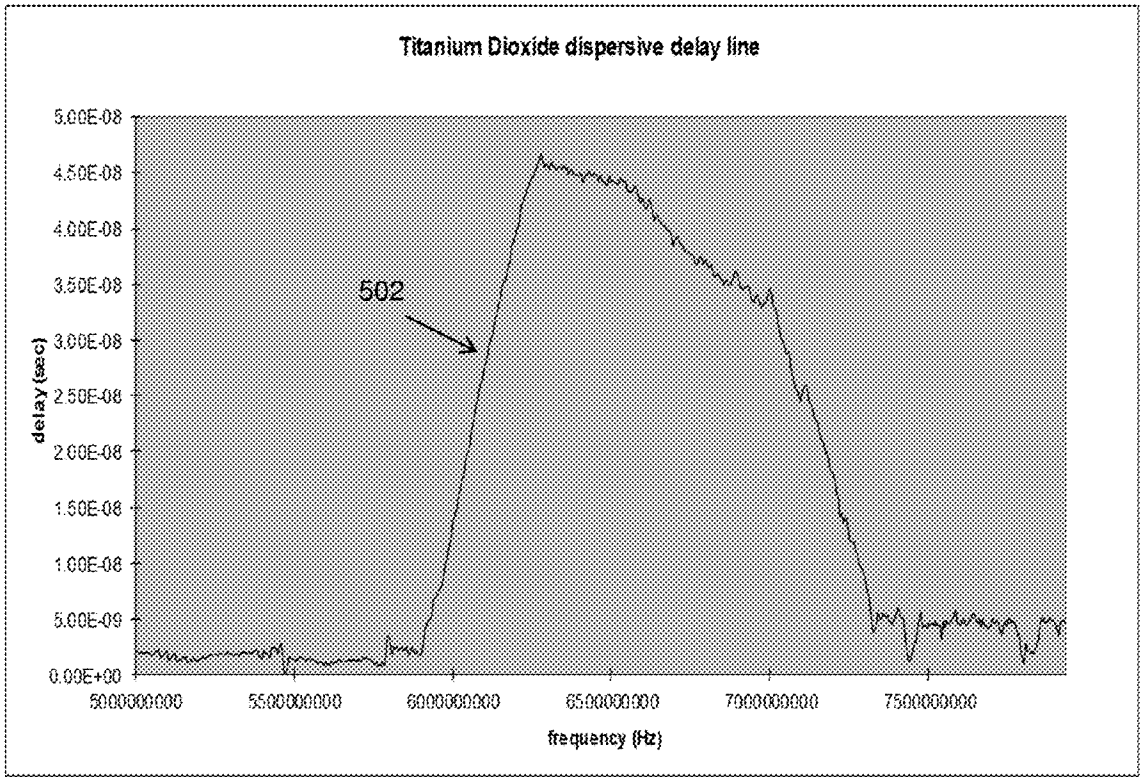
FIG. 5 is a dispersion curve for the piecewise linear arc surface electromagnetic wave dispersive delay line.

FIG. 5 is a plot of delay versus frequency for a piecewise linear implementation of the titanium dioxide dispersive delay line such as that shown in FIG. 4. The structure was fabricated using seven slabs 402 each of length x and width $\lambda$. The slabs in this implementation did not have microstrips deposited on top or bottom. As shown in the response curve, there is good linear behavior in a region 502. The wavelength of the linear region 502 corresponds to half the desired maximum wavelength. In this implementation, this occurs at approximately 6 GHz.

What is claimed is:

1. A surface electromagnetic wave dispersive delay line, comprising:

a waveguide manufactured from a dielectric material, the waveguide having a top surface and a bottom surface;

a first microstrip disposed on the top surface of the waveguide, separated from the top surface of the waveguide by a dielectric spacer;

feed elements coupled to the waveguide; and wherein the dispersive delay line is arranged in a spiral following a curvature defined by a desired transmission mode.

2. The dispersive delay line of claim 1 wherein the feed elements are horn antennas.

3. The dispersive delay line of claim 1 wherein the dispersive delay line is disposed on a ground plane.

4. The dispersive delay line of claim 1 wherein a second microstrip is disposed on the bottom surface of the waveguide, separated from the bottom surface of the waveguide by a second dielectric spacer.

5. The dispersive delay line of claim 1 wherein the desired transmission mode is an HE11 transmission mode.

6. The dispersive delay line of claim 1 wherein the dielectric material of the waveguide is titanium dioxide.

7. The dispersive delay line of claim 1 wherein the dielectric material of the waveguide is barium tetratitanate.

8. The dispersive delay line of claim 1 wherein the spiral is an Archimedean spiral.

9. The dispersive delay line of claim 1 wherein the dispersive delay line is constructed in a continuous fashion.

10. The dispersive delay line of claim 1 wherein the dispersive delay line is constructed from linear slabs of the dielectric material in a piecewise linear fashion, the arrangement of the slabs following the curvature defined by the desired transmission mode.

11. The dispersive delay line of claim 1 wherein a thickness of the dispersive delay line is constant over a length of the waveguide.

* * * * *